US010907432B2

(12) United States Patent
Evertsen

(10) Patent No.: US 10,907,432 B2
(45) Date of Patent: Feb. 2, 2021

(54) APPARATUS FOR REMOVING A SECTION OF CASING OR LINING FROM A WELL-BORE, AND METHODS

(71) Applicant: ARDYNE HOLDINGS LIMITED, Aberdeen (GB)

(72) Inventor: Steffen Evertsen, Tanager (NO)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 183 days.

(21) Appl. No.: 16/088,498

(22) PCT Filed: Apr. 20, 2017

(86) PCT No.: PCT/EP2017/059345
§ 371 (c)(1),
(2) Date: Sep. 26, 2018

(87) PCT Pub. No.: WO2017/182549
PCT Pub. Date: Oct. 26, 2017

(65) Prior Publication Data

US 2019/0048677 A1 Feb. 14, 2019

(30) Foreign Application Priority Data

Apr. 21, 2016 (GB) ..... 1606977.5

(51) Int. Cl.
*E21B 31/20* (2006.01)
*E21B 29/00* (2006.01)

(52) U.S. Cl.
CPC ..... *E21B 31/20* (2013.01); *E21B 29/002* (2013.01)

(58) Field of Classification Search
CPC ..... E21B 29/002; E21B 31/20; E21B 31/00; E21B 31/08; E21B 31/12
See application file for complete search history.

(56) References Cited

U.S. PATENT DOCUMENTS 2,329,939 A 9/1943 Phipps
2,627,316 A 2/1953 Baker
(Continued)

FOREIGN PATENT DOCUMENTS

GB 1458592 A 12/1976

OTHER PUBLICATIONS

International Search Report dated Aug. 9, 2017 for PCT/EP2017/059345.

*Primary Examiner* — Caroline N Butcher
(74) *Attorney, Agent, or Firm* — Law Office of Jesse D. Lambert, LLC

(57) ABSTRACT

Apparatus and method for removing a section of casing or lining from a wellbore. A tubular mandrel has a sliding assembly mounted thereon with grippers coupled to the assembly so that the grippers can be moved between an engaged configuration were they grip the inner wall of the casing section and a disengaged position were they are held away from the inner wall. A switcher is mounted on the mandrel which operates on entering the casing section to lock the grippers in the disengaged position so that cutting of the casing may be done. On pulling the switcher from the casing section, the grippers are automatically engaged and grip the upper end of casing section so that it can be removed. Additional locking arrangements are described which, by rotation, maintain the grippers in the disengaged position regardless of the location of the switcher.

19 Claims, 9 Drawing Sheets

(56) References Cited

U.S. PATENT DOCUMENTS

| | | | | |
|---|---|---|---|---|
| 2012/0111556 | A1 | 5/2012 | Palmer et al. | |
| 2014/0027117 | A1* | 1/2014 | Hekelaar | E21B 31/107 166/297 |
| 2016/0076327 | A1* | 3/2016 | Glaser | E21B 31/20 166/301 |

* cited by examiner

APPARATUS FOR REMOVING A SECTION OF CASING OR LINING FROM A WELL-BORE, AND METHODS

TECHNICAL FIELD

The present invention relates in particular to apparatus for removing a section of casing or lining from a wellbore, and related methods.

BACKGROUND

In the oil and gas exploration and production industry, tubular casing or lining is commonly installed in a wellbore that has been drilled into the subsurface of the Earth. Sections are inserted in the wellbore to make up the casing or lining and these are typically cemented in place by delivering cement material into an annulus between an outside of the section of casing or lining and the wall of the wellbore into which the section of casing or lining is inserted.

The provision of casing of lining in a wellbore may typically help to stabilise of the wellbore wall, for example by preventing collapse of formation material into the wellbore, and can help to control pressure and provide fluid containment in the wellbore during use of the wellbore, such as when drilling or producing oil or gas.

In various situations it can be desirable to remove a section of the casing or lining which has previously been installed in a wellbore. Typically, this involves cutting the casing to produce a cut section of a manageable size, and then pulling out the cut section to remove it from the wellbore. Removal of casing or lining may be a necessary and important part of a plug and abandonment operation for abandoning a well, where there may typically be a need to remove the casing in order to provide a suitable plug for the well.

Previous approaches to removing sections of casing or lining have involved running a cutting tool and a pulling tool into the wellbore in separate trips for performing the cutting and pulling operations respectively. By performing these operations in separate trips however, such approaches can be inefficient and costly.

Other prior techniques are known where the cutting and pulling can be performed on the same trip in the wellbore. In such a technique, a work string may be used that incorporates a tool for cutting the casing or lining and a tool for pulling the cut section. The tools may then be inserted into the section of casing to be removed. The cutting tool may typically require rotation of the work string and circulation of fluid into and out of the wellbore to perform and facilitate a circumferential cut of the casing. The pulling tool may typically operate to engage the inner wall of the section of casing to grip onto the casing and allow the section be pulled out to remove it from the wellbore. When deployed together with the cutting tool, there is a need for the pulling tool to allow the cutting process to take place while remaining on hand for performing pulling when required.

However, when deployed together with a cutting tool, pulling tools may suffer wear and damage as result from rotating the string during a cutting operation, or may interfere with the cutting process, and/or the circulation of fluid in a cutting process.

Pulling tools are known to exist for use in work strings together with cutting tools. The inventors note however that these can suffer from drawbacks in complexity, flexibility and ability to accommodate the cutting process while remaining on hand for removing a section of casing or lining.

For example, certain pulling tools (also known as "spears") are known to have selective actuation requiring rotation of the string, for example by turning the string a quarter turn clockwise, to move grippers on the pulling tool into or out of an engaging position with the wall of the casing section. With such kinds of actuation requirement, it can be difficult to determine whether the actuation has successfully taken place. This may in turn result in delays and/or operational uncertainty.

It is an aim of the invention to obviate or at least mitigate various drawbacks or difficulties associated with prior techniques.

SUMMARY OF THE INVENTION

In light of the above, according to a first aspect of the invention there is provided apparatus for removing a section of casing or lining from a wellbore, the tool comprising:

- a tubular mandrel arranged to be connected in a tubular string for inserting the tool into said section of tubing or lining, the mandrel having a longitudinal axis;
- a sliding assembly mounted on the mandrel;
- at least one gripper for gripping onto an inner wall of the section of casing or lining upon insertion therein, the gripper being coupled to the sliding assembly;
- the sliding assembly being operable for moving the gripper between a first position in which the gripper is arranged to grip onto the inner wall of the section of casing or lining in at least one gripping region of the section of casing or lining and a second position in which the gripper is held away from the inner wall; and
- a switcher which, when advanced into the section of casing or lining, locks the sliding assembly to the mandrel with the gripper in the second position; and, when the apparatus is pulled upward out of the section of casing or lining and the switcher exits the end of the section of casing or lining, automatically allows engagement of the section of casing or lining by the gripper in the first position.

The switcher may typically be configured to be activated by interaction with the casing or lining at or near an uphole end of the section of casing or lining, e.g. by engaging the end of the casing, e.g. an edge surface of the uphole end of the section of casing or lining.

The sliding assembly may be operable for moving the gripper between the first and second positions by relative axial movement between the sliding assembly and the mandrel, without requiring rotation therebetween.

The sliding assembly may be movable axially along the mandrel by fluid exerting pressure on a surface of the sliding assembly, for holding the gripper away from the inner wall.

The apparatus may further comprise at least one locking member configured to lock the sliding assembly with respect to the mandrel when the gripper are held away from the inner wall in the first position. The locking member may be activated to lock by the relative axial movement between the sliding assembly and the mandrel. The locking member may comprise at least one locking pin arranged for locking between the sliding assembly and the mandrel. Upon axial movement of the sliding assembly along the mandrel, the locking pin may be moved into position for locking the sliding assembly and the mandrel to one another, such that the gripper may be held away from the wall in the first position.

The switcher may comprise at least one dog arranged to be radially depressed so that the locking member can lock the sliding assembly with respect to the mandrel in the first position in which the grippers are held away from the wall. The dog may be configured to engage with an end of the section of casing or lining in use so as to be depressed for locking by engagement of the dog against the end of the section of casing or lining.

The dog may have an engaging surface arranged to be pitched at an angle to the end of the section of casing or lining in use, such that upon engaging the end of the section of casing of lining, movement between the sliding assembly and the casing can be resisted for allowing axial movement of the mandrel to take place with respect to the sliding assembly and the dog can be activated such that a locking member on the dog may be engaged to lock between the mandrel and the sliding assembly.

The dog may be configured to be depressed to lock between the sliding assembly and the mandrel, in order to allow the apparatus to be moved through the section of casing or lining from one location to another therealong.

The apparatus may have a plurality of grippers for gripping onto an inner wall of the section of casing. The sliding assembly may comprise a sleeve which may be arranged to surround the mandrel. The grippers may be spaced apart from one another around a circumference of the sleeve. The grippers may typically comprise ribs arranged to extend along the sleeve.

The gripper may be arranged to slide on an outer surface on the mandrel. The outer surface may be inclined with respect to the longitudinal axis for positioning the gripper in a radial position dependent upon the axial position of the sliding assembly with respect to the mandrel.

The apparatus may comprise biasing means, e.g. a spring, which may be operable between the mandrel and the sliding assembly, for biasing the sliding assembly relative to the mandrel for urging the gripper toward a radially outward position and/or a radially outermost achievable position. The gripper may be configured to obtain the outermost achievable position for gripping onto the internal wall of the tubing when the sliding assembly is not locked with respect to the mandrel.

The apparatus may be configured for allowing fluid to circulate through the mandrel and through a section of an annulus between the casing or lining and an outside of the apparatus. The mandrel may further comprise a passageway for the circulating fluid to enter a region in which the fluid may exert a pressure against a surface of the sliding assembly for moving the sliding assembly axially relative to the mandrel for withdrawing the gripper away from the inner wall of the section of casing or lining.

The sliding assembly may have a first locking position along mandrel, in which the gripper may be held away from the internal wall of the casing or lining, and in which the sliding assembly may be lockable to the mandrel by a first locking member. The sliding assembly may have a second locking position in which the mandrel may be rotated with respect to the sliding assembly and the gripper may be held away from the inner wall of the casing or lining. In the second locking position, the sliding assembly may be lockable to the mandrel while the first locking member is non-active. The apparatus may comprise a clutch-based locking mechanism for locking in the second locking position. The clutch-based locking mechanism may comprise a clutch ring comprising steps which are offset axially, and a locking formation which may be arranged to be rotated relative to one another into engagement with the steps to lock the mandrel and the sliding assembly in fixed axial position relative to one another.

The apparatus may be a pulling tool. The tubular string may include a cutting tool.

According to a second aspect of the invention, there is provided apparatus for removing a section of casing or lining from a wellbore, the apparatus comprising:

- a tubular mandrel arranged to be connected in a tubular string for inserting the apparatus into said section of tubing or lining, the mandrel having a longitudinal axis;
- a sliding assembly mounted on the mandrel;
- at least one gripper for gripping onto an inner wall of the section of casing or lining upon insertion therein, the gripper being coupled to the sliding assembly;
- the sliding assembly being operable for moving the gripper between a first position in which the gripper is arranged to grip onto the inner wall of the section of casing or lining and a second position in which the gripper is held away from the inner wall.

According to third aspect of the invention, there is provided apparatus for removing a section of casing or lining from a wellbore, the apparatus comprising:

- a tubular mandrel arranged to be connected in a tubular string for inserting the apparatus into said section of tubing or lining, the mandrel having a longitudinal axis;
- at least one gripper for gripping onto an inner wall of the section of casing or lining upon insertion therein, the gripper being movable between a first position in which the gripper is arranged to grip onto the inner wall of the section of casing or lining in at least one gripping region of the section of casing or lining and a second position in which the gripper is held away from the inner wall; and
- a switcher which, in at least one mode, is operable automatically in dependence upon a position relative to the section of casing or lining, such that the gripper is arranged to grip onto the inner wall of the section when in the gripping region and is held away from the inner wall when outside of the gripping region, in use.

According to a fourth aspect of the invention, there is provided a work string for cutting a casing or lining in a wellbore and removing a section of the casing or lining from the wellbore, the work string comprising apparatus as claimed in any preceding claim, and a cutting tool for cutting a casing or lining.

The work string may typically be a tubular string. The work string may typically be a rotary string.

According to a fifth aspect of the invention, there is provided a method of using the apparatus of any of the first to third aspects in a wellbore.

According to a sixth aspect of the invention, there is provided a method of removing a section of casing or lining from a wellbore using the apparatus of any of the first to third aspects, the method comprising the steps of:

(a) running the apparatus into the wellbore and into the section of casing or lining;
(b) advancing the switcher into the section of casing or lining,
(c) locking the sliding assembly to the mandrel with the gripper in the second position;
(d) pulling the apparatus upward out of the section of casing or lining so that the switcher exits the end of the section of casing or lining;
(e) automatically allowing engagement of the section of casing or lining by the gripper in the first position; and (f) moving the apparatus uphole, the section of casing or lining being attached thereto, to remove the section of casing or lining.

The method may further comprise: moving the apparatus to a position in the section of casing or lining where the gripper may be held away from the inner wall of the section of casing or lining, via operation of the switcher; and performing a cutting operation in the wellbore to produce a cut section of casing or lining to be removed.

Any of the aspects of the invention may include the further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

Embodiments of the invention are advantageous in various ways as will be apparent from the specification throughout.

DESCRIPTION AND DRAWINGS

There will now be described, by way of example only, embodiments of the invention with reference to the accompanying drawings, in which:

FIG. 5C illustrates in close up the features within the framed area marked in FIG. 5A.

Figure 1:
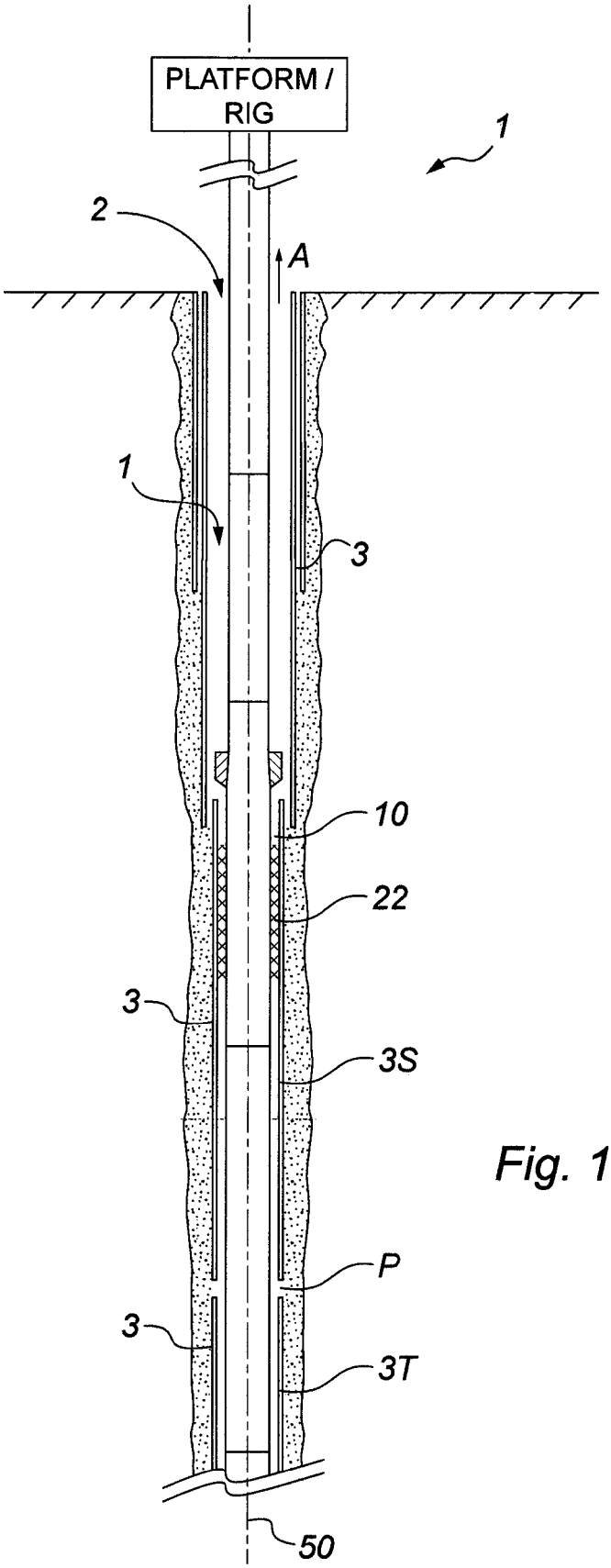
FIG. 1 is a schematic representation of apparatus incorporating a tool for removing a section of casing or lining from a wellbore according to an embodiment of the invention when in use in the wellbore.

With reference to FIG. 1, there is illustrated apparatus comprising a work string 1 in a wellbore 2 in which casing 3 has been installed. The work string 1 incorporates a tool 10 for use in removing a casing section 3*s* of the casing 3. The section 3*s* is sectioned off from the remaining downhole casing 3*t* by a circumferential cut at the location P, performed by using a cutting tool (not shown), so that the section 3*s* is detachable and can be pulled away from the downhole casing 3*t* for removing the casing section 3*s* from the wellbore. The work string 1 may be lowered and/or lifted via equipment (not shown) on a platform or rig.

The tool 10 has grippers 22, which in FIG. 1 are shown in an engagement position against an inner wall of the casing section 3*s*. In this position, the tool 10 can grip onto the casing section 3*s*. In response to pulling the work string 1, in the direction indicated by arrow A, i.e. uphole, the work string 1 is tensioned and the grippers 22 are urged to exert a radial component of force against the internal wall of the casing section 3*s*, so as to facilitate a secure grip onto the casing section 3*s*. The casing section 3*s* can thus be carried by the work string 1 via the connection of the grippers 22, and pulled out of the wellbore.

Figure 2A:
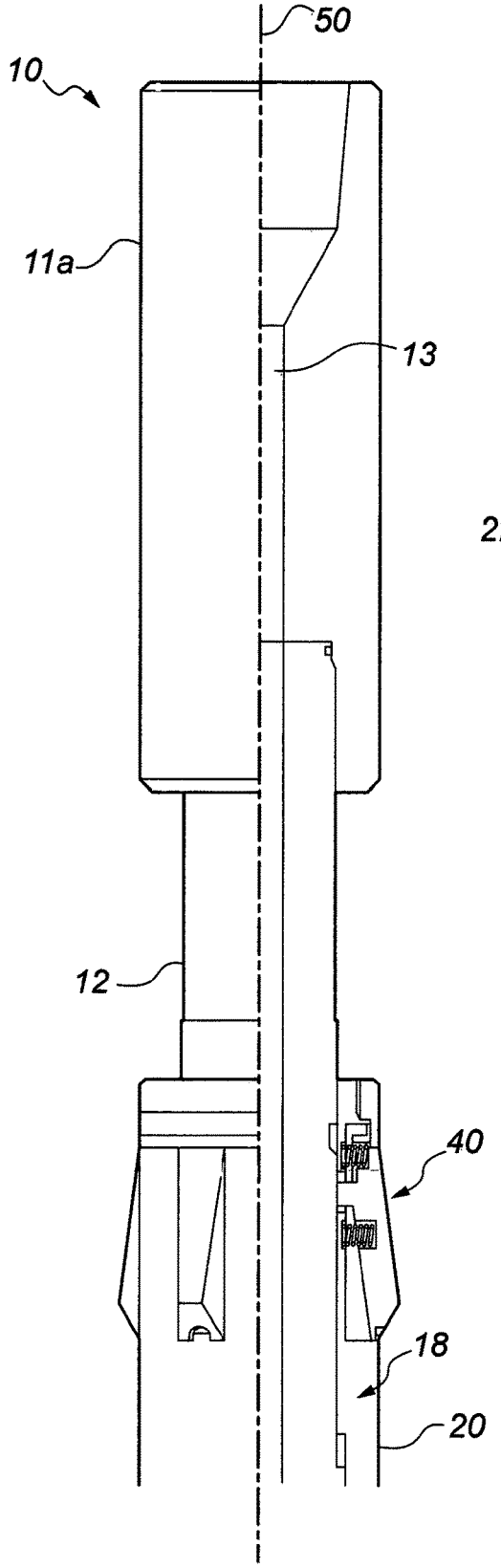
FIGS. 2A to 2C are quarter sectional representations of a tool for removing a section of casing or lining from a wellbore in sequential parts from top to bottom, in a first position and in close up, according to an embodiment of the invention.
Figure 2B:
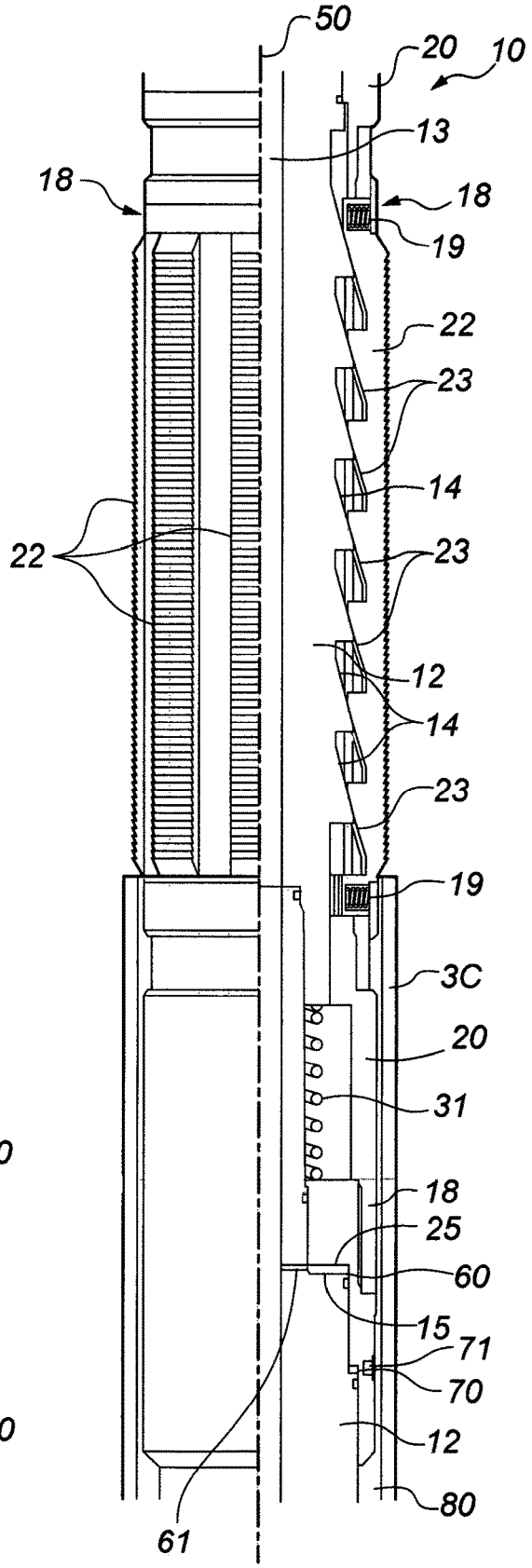
Figure 2C:
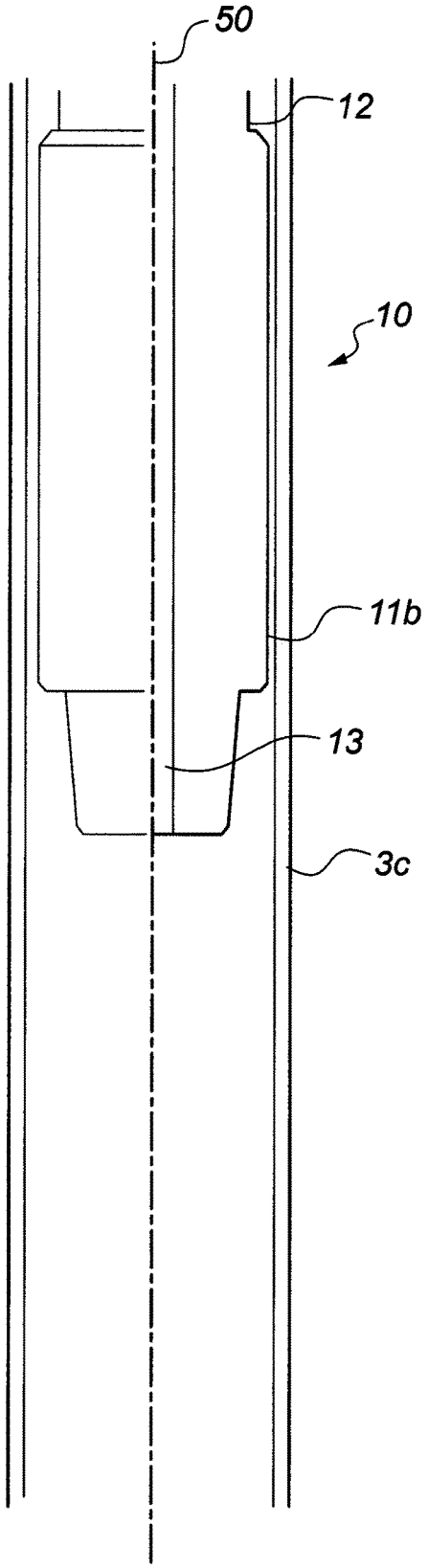

The tool 10 and features of its operation will be now described in further detail, turning firstly to FIGS. 2A to 2C. The tool 10 has first and second ends comprising respectively threaded box and pin sections 11*a*, 11*b* by which the tool 10 is connected (e.g. screwed together) to adjacent sections (not shown) of the work string 1. The tool 10 has a mandrel 12 which is tubular and which extends longitudinally between the box and pin sections 11*a*, 11*b*. The mandrel 12 has an axial through-going bore 13 suitable for circulating fluid inside the string and through the tool from one end to the other. This can help to allow delivery and circulation fluid into the wellbore at a downhole end of the string for facilitating a cutting operation for cutting the casing. The cutting may therefore be performed using a cutting tool positioned on the same work string.

A sliding assembly 18 is mounted on the mandrel 12. The sliding assembly 18 includes a sleeve 20 provided with a plurality of grippers 22 for gripping onto an inner wall of the section of casing 3*c*, when inserted thereinside. The grippers 22 bear against the mandrel 12 and are kept against the mandrel 12 by radial springs 19 acting between the sleeve 20 and the respective gripper 22 where the sleeve overlaps the gripper. The sliding assembly 18 is movable axially along the longitudinal axis 50 with respect to the mandrel 12. When the sliding assembly 18 is moved axially, the grippers 22 travel along the mandrel on slip surfaces 14 which are pitched at a shallow angle with respect to the longitudinal axis 50, so as to allow the grippers to move into different radial positions accordingly.

The tool 10 is further provided with a spring 31 that acts between the mandrel and the sleeve 20 to position the sliding assembly 18 axially along the mandrel, and to determine in turn the radial position of the grippers. In FIG. 2B, the grippers 22 are biased to their outermost permissible radial position.

FIGS. 2A to 2C show the tool in a run-in position before the grippers enter the end of the casing section 3*c*, and the grippers 22 define diameter greater than the of inside of the casing. The tool 10 has been run into the wellbore on the string 1 bringing the ends of the grippers 22 into engagement with the end of the casing section 3*c*. From this position, the tool 10 can be inserted further into the casing section 3*c* by letting the string progress downhole. With the ends of the grippers 22 in engagement with the end of the casing section 3*c*, movement of the string downhole urges the mandrel 12 to move relative to the sliding assembly 18 against the bias of the spring 31. Consequently, the grippers 22 follow the slip surfaces 14 to retract radially sufficiently to allow the tool 10 and grippers 22 to progress into the casing section 3*c*.

Figure 3A:
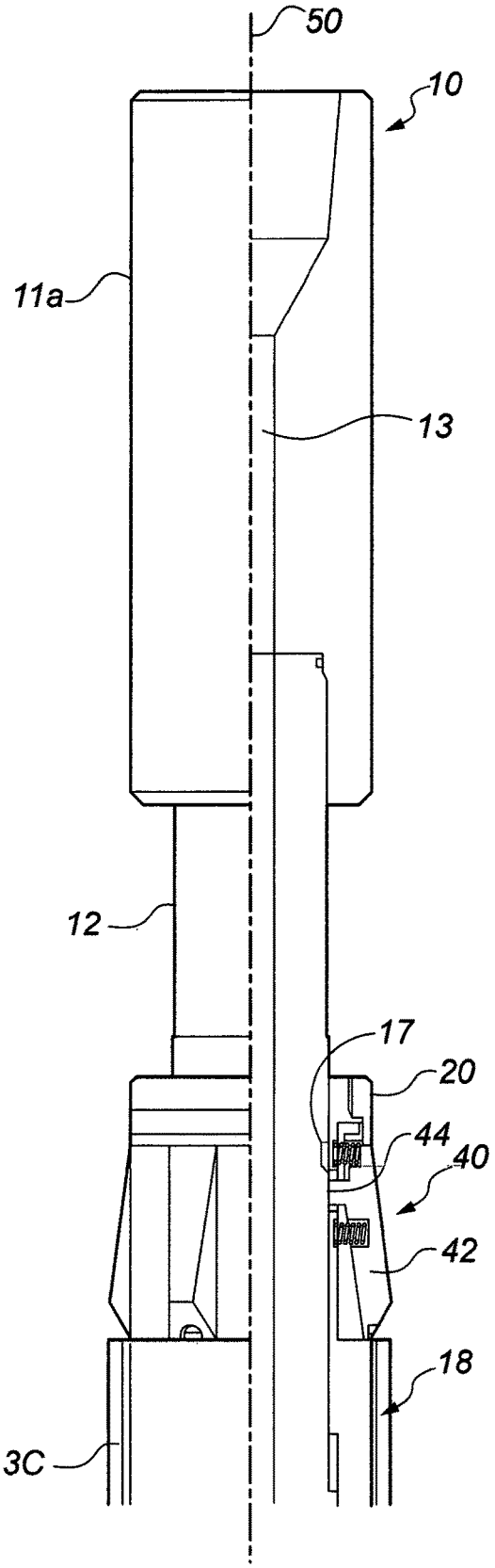
FIGS. 3A to 3C are quarter sectional representations of the tool of FIG. 2 in sequential parts from top to bottom, in second position.
Figure 3B:
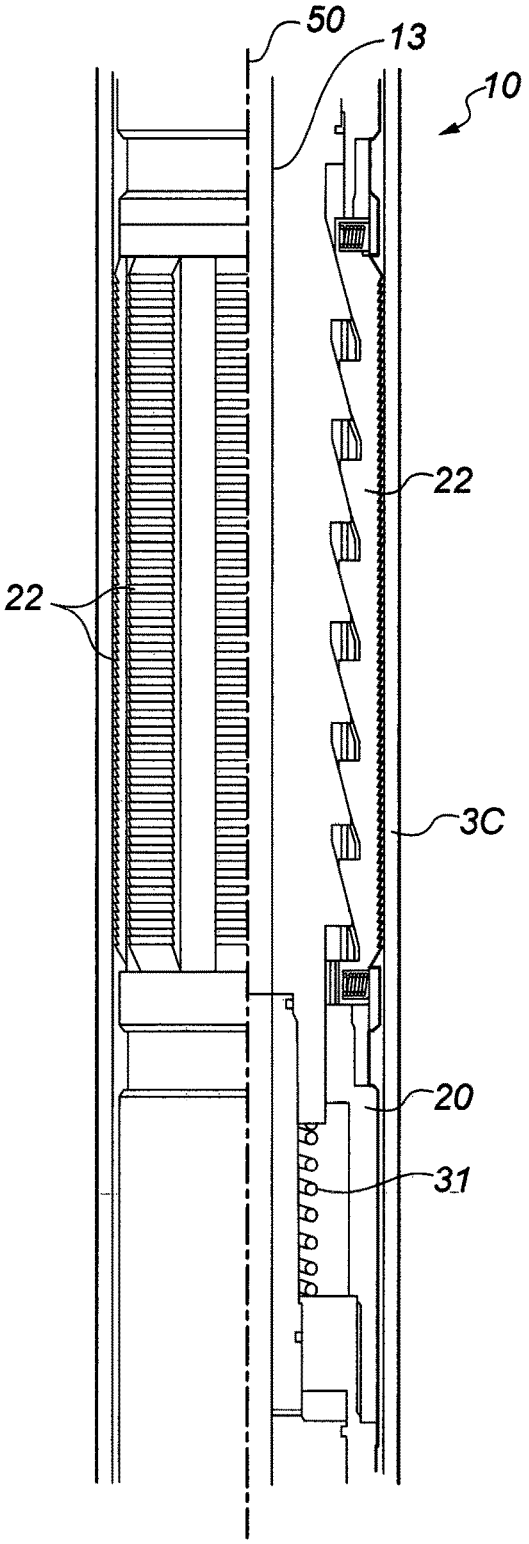
Figure 3C:
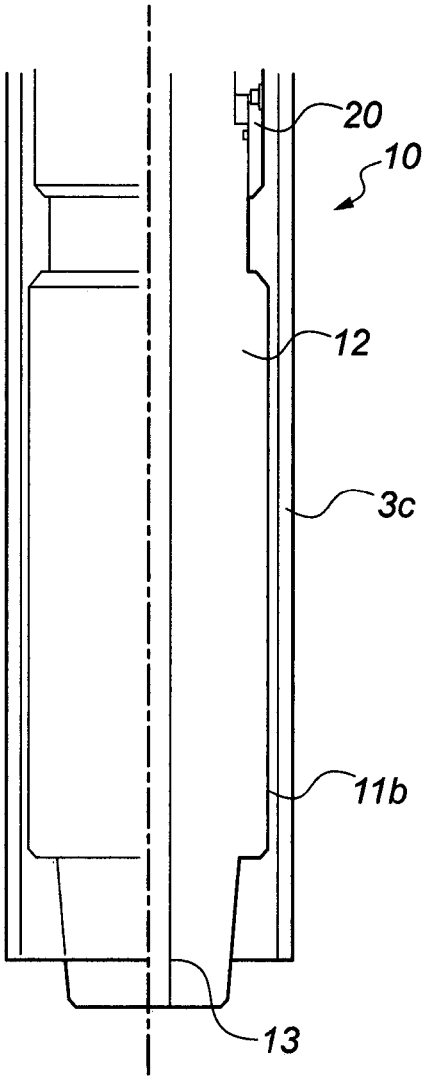

Upon insertion, the grippers 22 are positioned against the inside wall of the casing section 3*c*, as a result of the bias exerted by the spring 31 operating on the sleeve 20. From this position, the casing section 3*c* can be gripped by the tool 10 by pulling the string axially uphole. The pull of the string results in the mandrel 12 being urged in the direction of the arrow A (FIG. 1), i.e. uphole, and wedging the grippers 22 forcefully between the slip surfaces 14 and the casing, a radial component of force being imparted via the grippers 22 against the inside wall of the casing section 3*c*. FIGS. 3A to 3C show an example of such a position in which the tool 10 is set ready to grip onto the casing section 3*c* by pulling the string uphole to remove the casing section 3*c*.

With reference particularly now to FIGS. 3A to 3C, an upper end of the sliding assembly 18 includes a locking device 40 (a "switcher") having a plurality of locking dogs 42 spaced apart from one another and disposed around the circumference of the sleeve 20. The locking dogs 42 are able to operate to lock the sliding assembly 18 to the mandrel 12. In order to lock the sliding assembly 18 to the mandrel 12, the following is required: 1) the sleeve 20 needs to be moved to a locking position with respect to the mandrel 12 where it can be locked by the locking dogs 42; and 2) the locking dogs 42 need to be activated to lock the sleeve 20 in the locking position.

Figure 4A:
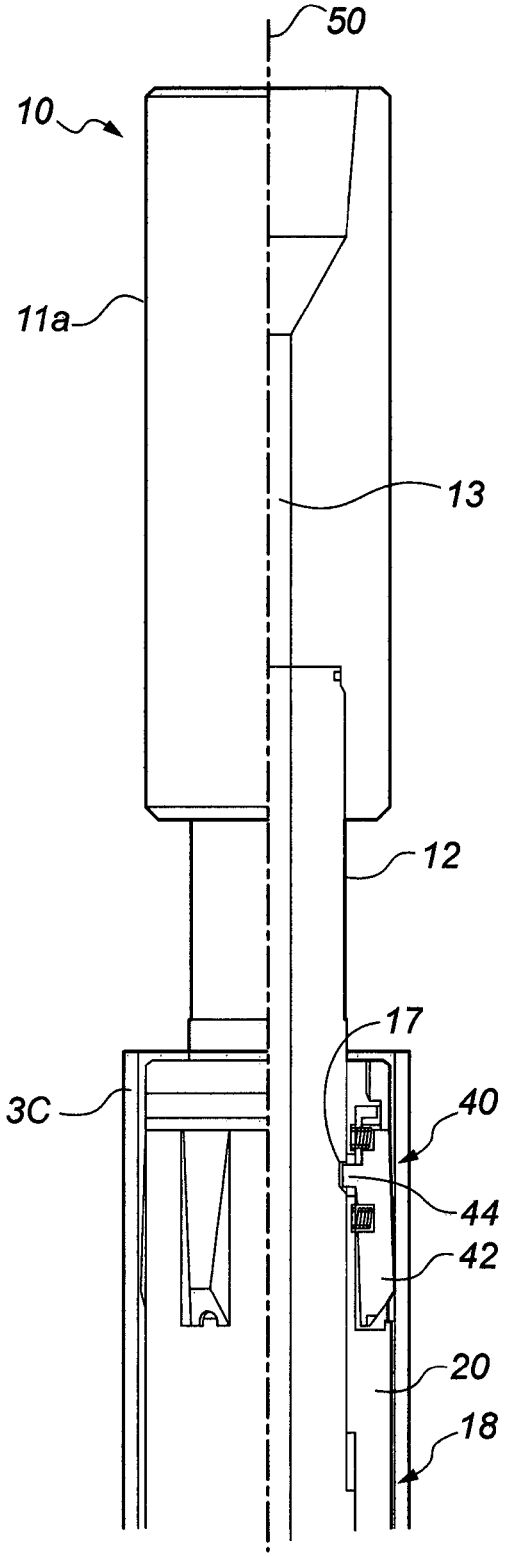
FIGS. 4A to 4C are quarter sectional representations of the tool of FIG. 2 in sequential parts from top to bottom, in a third position.
Figure 4B:
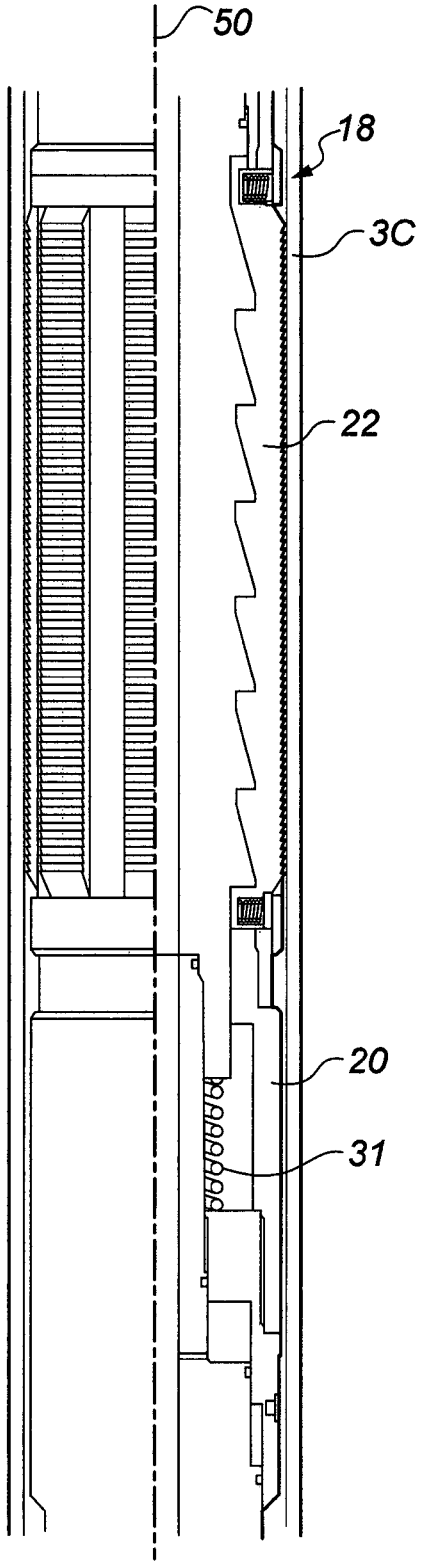
Figure 4C:
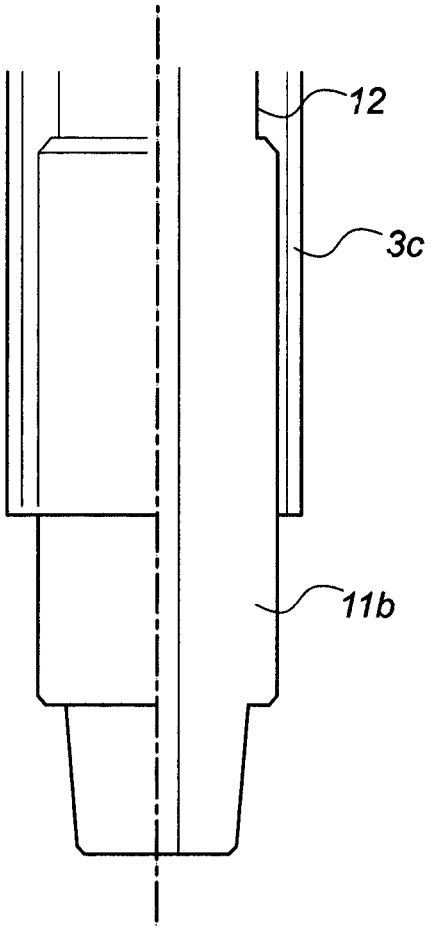

This is achieved as follows. The locking dogs 42 protrude outwardly from the sleeve 20. In this way, the locking dogs 42 are arranged to engage with the end of the casing section 3*c*, as shown in FIGS. 3A to 3C. When advancing the string further into the wellbore, the mandrel 12 is moved relative to the sleeve 20 since the sleeve is restrained against the end of the casing section 3*c* through the engagement of the locking dogs 42. The mandrel 12 is moved axially against the bias of the spring 31, thus compressing the spring 31, and bringing the mandrel 12 and sleeve 20 in relative position to allow locking to take place. Then, with reference now additionally being made to FIGS. 4A to 4C, by pressure applied through a front surface of the locking dogs 42 onto the end of the casing section 3*c*, the locking dogs 42 are pressed inward onto the mandrel 12 such that a locking pin 44 on the dog 42 interlocks with a recess 17 in the mandrel 12. When locked, relative axial movement between the mandrel 12 and the sliding assembly 18 is prevented. With the locking dogs 42 activated and the sleeve 20 locked to the mandrel 12, the tool 10 can progress further into the casing section 3*c* by advancing the work string 1. The locking dogs 42 are prevented from unlocking by the inside wall of the casing section 3*c*. Accordingly, the locking dogs 42 stay activated with the locking pin 44 interlocked with recess 17 in the mandrel 12, once the locking device 40 of the tool 10 is inserted inside the casing section 3*c*.

Notably, when placed in the locking position, the position of the sliding assembly 18 relative to the mandrel 12 is such that the grippers 22 are retracted and brought inwardly against the mandrel to obtain a radial position away from the inner wall of the casing section 3*c*. In this way, by axial longitudinal movement of the sliding assembly 18 along the mandrel 12, the grippers 22 can be moved to disengage from the wall.

With the grippers 22 away from the wall of the casing section 3*c*, various advantages are obtained. A cutting tool can be employed by way of rotating the string without the grippers 22 interfering with the cutting operation. The string may also be readily advanced further into the wellbore to access for instance a cutting location with a cutting tool, again with minimal or reduced risk of frictional wear on the grippers 22.

In the above is described a complete "normal" operational mode of the tool 10 allowing the engagement of the casing section 3*c* by the grippers 22 at the top end of the casing section 3*c*, disengagement and locking of the grippers 22 in the disengaged position. This is achieved automatically all by simple axial movements of the string along wellbore, and by axial relative movements between the mandrel 12 and the sliding assembly 18. No rotation of the string or the mandrel 12 (i.e. relative to the sliding assembly, about the axis 50) is required to lock or unlock or to engage or disengage the grippers 22 on the wall.

This facilitates simplicity of use and can reduce ambiguity as to whether the grippers 22 are engaged or disengaged from the wall of the casing section 3*c*. This may in turn reduce inefficiencies, potential re-runs in the wellbore, and/or possible error or damage to tools from false assumptions.

Nonetheless, the tool 10 has additional functionality. In particular, the sleeve 20 is fitted on the mandrel 12 for moving the sleeve 20 along the mandrel by fluid actuation. More specifically, fluid can access a region 60 between actuating surfaces 15, 25 of the mandrel 12 and the sleeve 20 respectively, so as to exert a pressure on the actuating surfaces 15, 25 and thereby force the mandrel and sleeve 20 to move axially with respect to one another. The pressure exerted by the fluid acts against the force of the spring 31, and when sufficiently high may exceed the spring force so as to compress the spring 31. The resulting movement of the sliding assembly 18 upward (in FIG. 2B for example), relative to the mandrel 12, brings the grippers 22 into a retracted radial position where they are positioned away from the wall of the casing section 3*c* such that while the pressure from the fluid is applied, they cannot engage with the wall. This functionality by fluid pressure may be useful to override the function of the locking dogs 42. In the normal mode of operation described above, the grippers 22 are urged outward for gripping onto the wall of the casing section 3*c* if the locking dogs 42 are removed from the casing. Hence, in the normal mode, the casing section 3*c* is always gripped by the grippers 22 at the top of the casing section 3*c* regardless of whether the tool is going to be moved further into the casing section 3*c*, or, having been inserted far into the casing section 3*c*, the tool is moved out of the casing section 3*c* again, because when the locking dogs 42 are deactivated, the mandrel 12 is unlocked from the sleeve 20.

If fluid pressure via the region 60 is used to force the grippers 22 into the retracted position, the status of the locking dogs 42 no longer matters. In other words, the locking dogs 42 can be unlocked, but the sliding assembly 18 is nonetheless held in the "locking" position along the mandrel 12 so that the grippers 22 are retracted although not actually locked by the dogs 42. This allows the tool 10 to be completely freed from the casing section 3*c* and recovered to the surface (without the casing section 3*c*) if required. Fluid actuation of the sleeve 20 via the region 60 may also be applied to help to move the sleeve 20 to the locking position before locking the mandrel 12 with the locking dogs 42 as described in relation to FIGS. 4A to 4C above.

The mandrel 12 has a passageway 61 connecting the bore 13 with the region 60 between the sleeve and the mandrel. Fluid circulated through the bore 13 of the mandrel 12 is therefore in communication with the region 60 via the passageway 61. The circulation of fluid through the bore into the wellbore can therefore be supplied to generate a suitable pressure in the region 60. In general, the pressure is low such that the sleeve 20 is biased under the force of the spring 31, but the pressure may be increased so as to compress the spring 31 and move the sleeve by fluid actuation when needed. A port 70 for letting in or out fluid is provided to equalise pressure between the region 70 and an annular space 80 of the wellbore so as to facilitate movement of the sleeve 20 along the mandrel 12.

The tool 10 also has a second locking position, which can be obtained by moving the sliding assembly 18 to a location along the mandrel 12 (e.g. first locking position) where the grippers 22 are disengaged from the wall of the casing section, and then rotating the sliding assembly relative to the mandrel 12 by turning the string into the second locking position. The rotation brings a formation (not shown) on an inside of the sleeve 20 into a J-groove in the mandrel so as to lock the sleeve 20 with respect to the mandrel 12 in the second locking position, with the grippers 22 disengaged, independent of the activation status of the locking dogs 42. Again, this allows the tool 10 to be completely freed from the casing section 3*c*, if the need arises and if fluid may not be available to disengage the grippers hydraulically.

Through the fluid actuation and rotational mechanical locking to hold the grippers away from the wall of the casing section 3*c*, the tool 10 has a release mode where the tool can be released from the casing section 3*c* and retrieved from the wellbore at any time.

Figure 5A:
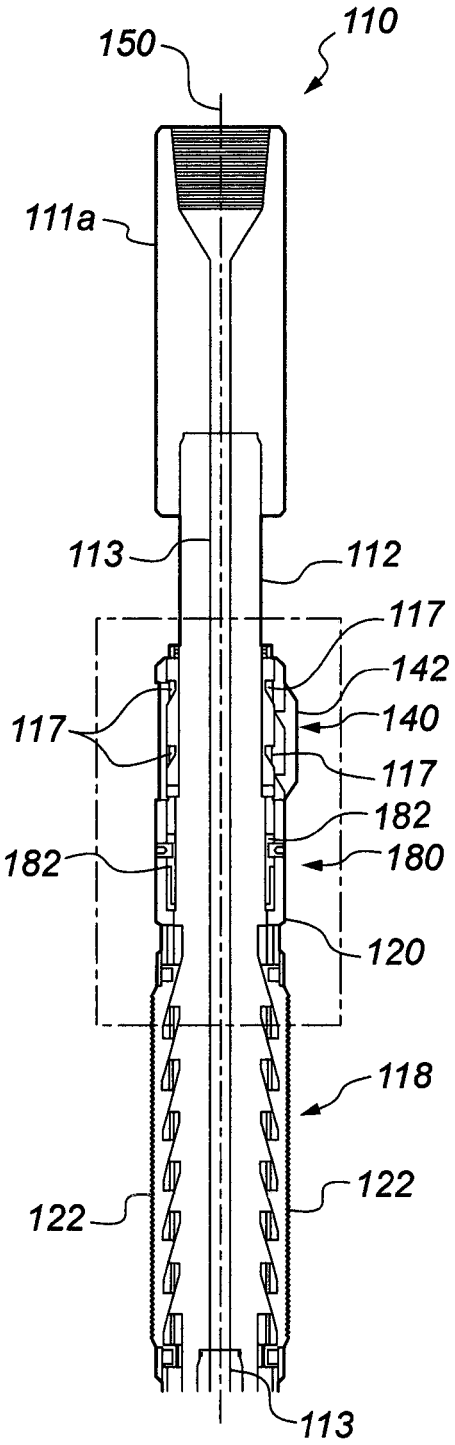
FIGS. 5A to 5C are sectional representations of a tool for removing a section of casing or lining from a wellbore according to another embodiment, where
Figure 5B:
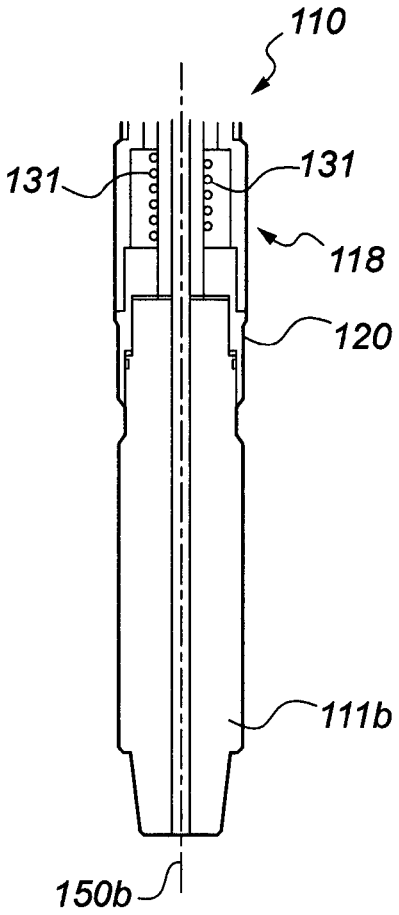
Figure 5C:
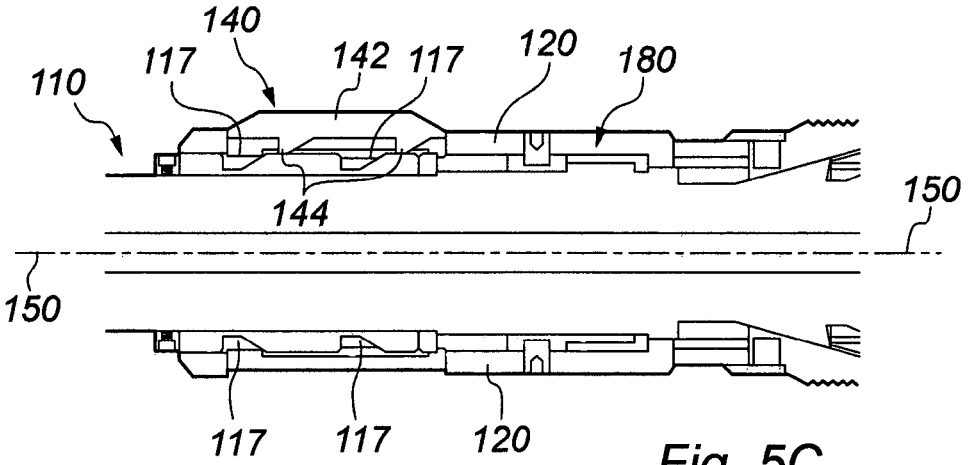

With reference now to FIGS. 5A to 5C, another tool 110 for removing a section of tubing or lining is exemplified. The tool 110 may be employed in the work string 1 instead of the tool 10 for use in removing and pulling out the casing section 3*c*. The tool 110 functions in primarily the same way as the tool 10. However, the tool 110 is configured somewhat differently in respect of the locking device 140, and with regard to the rotational locking function, where the tool 110 does not use a J-groove, but instead is provided with a clutch-based locking mechanism 180.

In this example, like features in the tool 110 are referenced with the same numerals as in relation to the tool 10 but incremented by one hundred.

FIGS. 5A to 5C show the tool 110 in a configuration corresponding to that of the tool 10 in FIGS. 2A to 2C. The sliding assembly 118 is biased downward with respect to the mandrel 112 via spring 131. The grippers 122 are in an extended radial position where they are capable of adapting to fit the internal circumference and gripping onto an internal wall of the casing section 3*c* in use.

The locking dogs 142 are coupled to the sleeve 120 of the sliding assembly 118. The mandrel 112 is provided with locking recesses 117 for receiving a wedged locking member of the locking dogs 142. Depending upon the relative axial position of the sleeve 120 relative to the mandrel 112, the locking dogs 142 can be moved into a locking position in which the dogs 142 can lock the sleeve 120 to the mandrel 112, by the locking member entering the recesses 117 such that they are interlocked. As with the tool 10, such that locking is achieved by inserting the tool 110 into the casing section 3*c*, so that a front end of the locking dogs 142 engage an end of the casing section 3*c*, and then letting the weight of the string shift the mandrel 112 downward relative to the sleeve 120 while it is held on the end of the casing by the locking dogs 142. The relative movement axially between the sleeve 120 and the mandrel 112 allows the locking dogs 142 to be depressed inwards due to the contact with the end of the casing section 3*c* and lock onto the mandrel 112. The tool 110 can then progress further and be fully inserted into the casing section 3*c*. When bringing the tool 110 upward out of the casing section 3*c*, and the locking dogs 142 exit the end of the casing section 3*c*, the mandrel 112 is free to be drawn upward relative to the sleeve 120 which simultaneously is biased downward by the spring 131. As a result, the locking dogs 142 are brought out of the locking recesses 112, and the mandrel 112 and sleeve 120 are unlocked. The locking members of the locking dogs 142 are arranged to slip on a sloping surface of the recesses 117 to facilitate or urge movement into and out of the recesses 117 upon locking and unlocking respectively.

The tool 110 can also be locked with the grippers 22 held away from the wall of the casing section 3*c* by rotating the mandrel 112 to a second locking position, i.e. a rotated position of the mandrel with respect to the sleeve 120. This is achieved through the clutch-based locking mechanism 180.

With reference additionally to FIGS. 6A to 6D, the features of the clutch-based locking mechanism 180 can be seen in greater detail. The mechanism 180 has a clutch ring 182 which is fastened to the sleeve 120 and which surrounds the mandrel 112. The clutch ring 182 is thus part of the sliding assembly 118 so as to be slidable axially along the mandrel 112. The clutch ring 182 is provided with steps 184 which provide surfaces which are stepped away at different positions axially. A formation 193 of the mandrel 112, protruding outwardly on the mandrel 112, is arranged to be able to engage with one of the surfaces of the steps 184 to hold the sleeve 120 in position with respect to the mandrel 112 against the relevant step.

Figure 6A:
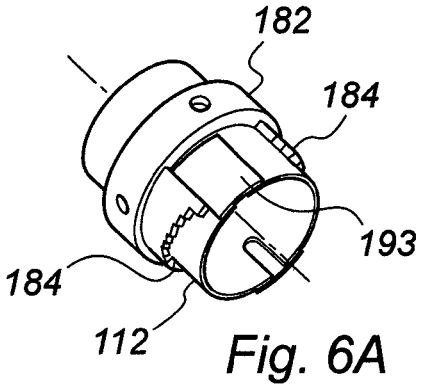
FIGS. 6A to 6D are perspective representations of parts of a clutch-based locking mechanism of the tool of FIGS. 5A to 5C.

In the configuration of the tool 110 as shown in FIGS. 5A to 5C, the clutch ring 182 is positioned as illustrated in FIG. 6A. In this position, none of the steps 184 are engaged, i.e. the clutch-based locking mechanism is not active, and rotation of mandrel 112 (if that should take place, e.g. when the string includes a cutting tool and the string is rotated to operate the cutting tool) then does not achieve any locking.

Figure 6B:
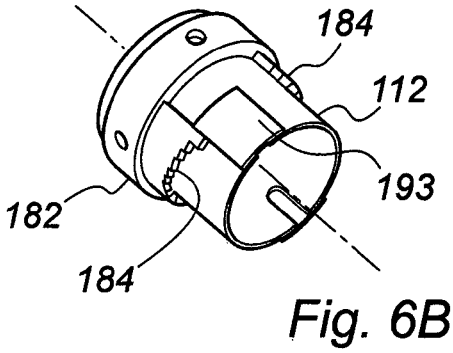
Figure 6C:
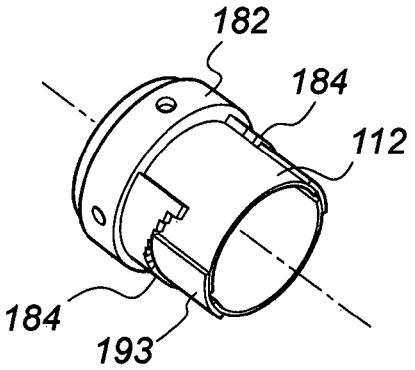
Figure 6D:
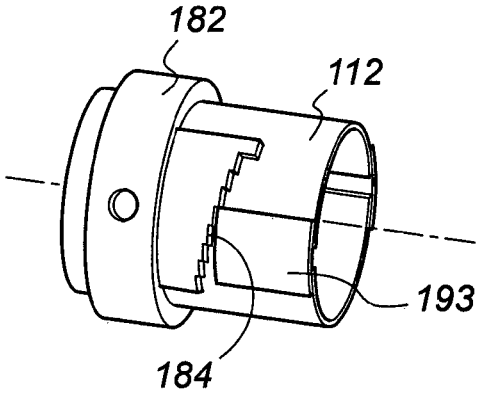

As seen in FIG. 6B however, as the sleeve 120 moves upward relative to the mandrel 112, the formation is moved axially with respect to the clutch ring 182. The grippers 122 are withdrawn away from the wall of the casing section 3*c*. From this position, as shown in FIGS. 6C and 6D, the mandrel 112 can be rotated anti-clockwise (viewed downhole), bringing the formation 193 onto one of the steps 184. The mandrel 112 is thus locked to the mandrel 112 in engagement with the step of the clutch ring 182, in a suitable axial position by which the grippers 122 are withdrawn. The tool 110 can thus be released from the casing section 3*c* without the grippers 122 being allowed to grip the casing section 3*c*, should this be required.

The sleeve 120 and mandrel 112 may be moved into an axial relative position where the grippers 122 are withdrawn, by fluid actuation or by using the weight of the string to move the mandrel 112 while the sleeve 120 is held on the end of the casing section 3*c* by the locking dogs 142, as described above. The use of the clutch ring 182 with multiple steps 184 at different axial distances can be advantageous because the axial distance moved by fluid actuation or engagement of the end of the casing section 3*c* may differ from time to time, for example depending upon the inner diameter of the casing section 3*c*. If there is a larger diameter, the locking dogs 142 may not depress fully and the locking members 144 may not fully key into the recesses 117 (but the grippers 122 may still be withdrawn sufficiently that they are held away from the inner wall of the casing section 3*c*). Thus, the clutch-based locking mechanism 180 can allow locking by rotation in different cases, where the amount of displacement between mandrel 112 and the sleeve 120 differs, by rotation onto the steps 184, whereby the formation 193 will meet and interlock with a surface of the appropriate one of the steps 184.

I claim:

1. An apparatus for removing a section of casing or lining from a wellbore, the apparatus comprising:

a tubular mandrel arranged to be connected in a tubular string for inserting the apparatus into said section of casing or lining, the mandrel having a longitudinal axis;

a sliding assembly mounted on the mandrel;

at least one gripper for gripping onto an inner wall of the section of casing or lining upon insertion therein, the gripper being coupled to the sliding assembly;

the sliding assembly being operable for moving the gripper between a first position in which the gripper is arranged to grip onto the inner wall of the section of casing or lining in at least one gripping region of the section of casing or lining and a second position in which the gripper is held away from the inner wall; and a switcher which, when advanced into the section of casing or lining, locks the sliding assembly to the mandrel with the gripper in the second position; and, when the apparatus is pulled upward out of the section of casing or lining and the switcher exits the end of the section of casing or lining, automatically allows engagement of the section of casing or lining by the gripper in the first position.

2. The apparatus as claimed in claim 1, wherein the sliding assembly is operable for moving the gripper between the first and second positions by relative axial movement between the sliding assembly and the mandrel, without requiring rotation therebetween.

3. The apparatus as claimed in claim 1, wherein the sliding assembly is movable axially along the mandrel by fluid exerting pressure on a surface of the sliding assembly, to hold the grippers away from the inner wall.

4. The apparatus as claimed in claim 1, further comprising at least one locking member configured to lock the sliding assembly with respect to the mandrel when the gripper is held away from the inner wall in the second position.

5. The apparatus as claimed in claim 4, wherein the locking member is activated to lock by the relative axial movement between the sliding assembly and the mandrel.

6. The apparatus as claimed in claim 4, wherein the locking member comprises at least one locking pin arranged for locking between the sliding assembly and the mandrel, whereby the upon the axial movement of the sliding assembly along the mandrel, the locking pin is moved into position for locking the sliding assembly and the mandrel to one another such that the gripper is held away from the wall in the first position.

7. The apparatus as claimed in claim 4, wherein the switcher comprises at least one dog arranged to be radially depressed so that the locking member locks the sliding assembly with respect to the mandrel in the second position in which the gripper is held away from the inner wall, the dog being configured to engage with the end of the section of casing or lining in use so as to be depressed for locking by engagement of the dog against the end of the section of casing or lining.

8. The apparatus as claimed in claim 7, wherein the dog has an engaging surface arranged to be pitched at an angle to the end of the section of casing or lining in use, such that upon engaging the end of the section of casing or lining, movement between the sliding assembly and the section of casing or lining can be resisted for allowing axial movement of the mandrel to take place with respect to the sliding assembly and the dog can be activated such that the locking member on the dog is engaged to lock between the mandrel and the sliding assembly.

9. The apparatus as claimed in claim 7, wherein the dog is configured to be depressed to lock between the sliding assembly and the mandrel, in order to allow the apparatus to be moved through the section of casing or lining from one location to another therealong.

10. The apparatus as claimed in claim 1, having a plurality of grippers for gripping onto an inner wall of the section of casing, and wherein the sliding assembly comprises a sleeve which is arranged to surround the mandrel, the grippers being spaced apart from one another around a circumference of the sleeve.

11. The apparatus as claimed in claim 10, wherein the grippers comprise ribs arranged to extend along the sleeve.

12. The apparatus as claimed in claim 1, wherein the gripper is arranged to slide on an outer surface on the mandrel which is inclined with respect to the longitudinal axis for positioning the gripper in a radial position dependent upon the axial position of the sliding assembly with respect to the mandrel.

13. The apparatus as claimed in claim 1, comprising a biasing means which is operable between the mandrel and the sliding assembly, for biasing the sliding assembly relative to the mandrel for urging the gripper toward a radially outermost achievable position.

14. The apparatus as claimed in claim 13, wherein the gripper is configured to obtain the outermost achievable position for gripping onto the internal wall of the tubing when the sliding assembly is not locked with respect to the mandrel.

15. The apparatus as claimed in claim 1, configured for allowing fluid to circulate through the mandrel and through a section of an annulus between the casing or lining and an outside of the apparatus, the mandrel further comprising a passageway for the circulating fluid to enter a region in which the fluid exerts a pressure against a surface of the sliding assembly for moving the sliding assembly axially relative to the mandrel for withdrawing the gripper away from the inner wall of the section of casing or lining to override the switcher when the switcher exits the end of the section of casing or lining.

16. The apparatus as claimed in claim 1, wherein the sliding assembly has a first locking position along the mandrel, in which the gripper is held away from the internal wall of the casing or lining and the sliding assembly is lockable to the mandrel by a first locking member, and a second locking position in which the mandrel is rotated with respect to the sliding assembly and the gripper is held away from the inner wall of the casing or lining, wherein in the second locking position the sliding assembly is lockable to the mandrel while the first locking member is non-active.

17. A work string for cutting a casing or lining in a wellbore and removing a section of the casing or lining from the wellbore, the work string comprising:

an apparatus, the apparatus comprising:

a tubular mandrel arranged to be connected in a tubular string for inserting the apparatus into said section of casing or lining, the mandrel having a longitudinal axis;

a sliding assembly mounted on the mandrel;

at least one gripper for gripping onto an inner wall of the section of casing or lining upon insertion therein, the gripper being coupled to the sliding assembly;

the sliding assembly being operable for moving the gripper between a first position in which the gripper is arranged to grip onto the inner wall of the section of casing or lining in at least one gripping region of the section of casing or lining and a second position in which the gripper is held away from the inner wall; and a switcher which, when advanced into the section of casing or lining, locks the sliding assembly to the mandrel with the gripper in the second position; and, when the apparatus is pulled upward out of the section of casing or lining and the switcher exits the end of the section of casing or lining, automatically allows engagement of the section of casing or lining by the gripper in the first position; and a cutting tool for cutting the casing or lining.

18. A method of removing a section of casing or lining from a wellbore using an apparatus comprising:

a tubular mandrel arranged to be connected in a tubular string for inserting the apparatus into said section of casing or lining, the mandrel having a longitudinal axis;

a sliding assembly mounted on the mandrel;

at least one gripper for gripping onto an inner wall of the section of casing or lining upon insertion therein, the gripper being coupled to the sliding assembly;

the sliding assembly being operable for moving the gripper between a first position in which the gripper is arranged to grip onto the inner wall of the section of casing or lining in at least one gripping region of the section of casing or lining and a second position in which the gripper is held away from the inner wall; and a switcher which, when advanced into the section of casing or lining, locks the sliding assembly to the mandrel with the gripper in the second position; and, when the apparatus is pulled upward out of the section of casing or lining and the switcher exits the end of the section of casing or lining, automatically allows engagement of the section of casing or lining by the gripper in the first position;

the method comprising the steps of:

(a) running the apparatus into the wellbore and into the section of casing or lining;

(b) advancing the switcher into the section of casing or lining, (c) locking the sliding assembly to the mandrel with the gripper in the second position;

(d) pulling the apparatus upward out of the section of casing or lining so that the switcher exits the end of the section of casing or lining;

(e) automatically allowing engagement of the section of casing or lining by the gripper in the first position; and (f) moving the apparatus uphole, the section of casing or lining being attached thereto, to remove the section of casing or lining.

19. A method as claimed in claim 18, which further comprises between steps (c) and (d), the step of performing a cutting operation in the wellbore to produce a cut section of casing or lining to be removed.

* * * * *